US005150584A

United States Patent [19]

Tomasov et al.

[11] Patent Number: 5,150,584

[45] Date of Patent: Sep. 29, 1992

[54] METHOD AND APPARATUS FOR DETECTING LOW REFRIGERANT CHARGE

[75] Inventors: Glenn E. Tomasov, Lockport; Annette M. Schmidt, Amherst, both of N.Y.

[73] Assignee: General Motors Corporation, Detroit, Mich.

[21] Appl. No.: 765,794

[22] Filed: Sep. 26, 1991

[51] Int. Cl.[5] ..... F25B 1/00

[52] U.S. Cl. ..... 62/209; 62/126; 62/227

[58] Field of Search ..... 62/227, 228.1, 126, 62/129, 209

[56] References Cited

U.S. PATENT DOCUMENTS 4,463,576 8/1984 Burnett et al. ..... 62/228.3
4,967,567 11/1990 Procter et al. ..... 62/129 X
5,009,074 4/1991 Goubeaux et al. ..... 62/115

FOREIGN PATENT DOCUMENTS 0148611 11/1980 Japan ..... 62/129
0164793 12/1980 Japan ..... 62/227

*Primary Examiner*—William E. Wayner
*Attorney, Agent, or Firm*—Mark A. Navarre

[57] ABSTRACT

In an air conditioning system, thermistors measure evaporator inlet and outlet temperatures and compressor body temperature. When the differential between inlet and outlet temperatures is below a first threshold and the compressor temperature is above a second threshold, very low refrigerant charge is indicated and the compressor is turned off. Also, if compressor temperature reaches a critical value, the compressor is turned off regardless of the temperature differential across the evaporator.

5 Claims, 2 Drawing Sheets

METHOD AND APPARATUS FOR DETECTING LOW REFRIGERANT CHARGE

FIELD OF THE INVENTION

This invention relates to the control of air conditioning systems, and more particularly, to the detection of low refrigerant charge.

BACKGROUND OF THE INVENTION

A valuable control feature for automotive air conditioning systems is the detection of low refrigerant, more particularly, of a complete loss of refrigerant. The refrigerant contains lubricant which is relied upon for compressor lubrication, and thus, the absence of such lubrication can lead to catastrophic failure.

A current system which employs cycling clutch control to turn the compressor on and off uses a pressure sensing switch which disengages the clutch when system pressures drop below a certain level. This switch protects against evaporator core freezing and also protects the compressor if most or all of the refrigerant in the system is lost. Such a pressure switch is an invasive device, that is, it makes direct contact with the refrigerant and thus furnishes a potential leak path. It is desirable to reduce the number of such potential leak paths and thus improve system integrity.

A noninvasive control system has been proposed which protects against evaporator core freezing by utilizing a thermistor in the evaporator core on the air side. That system can be designed to detect partial loss of refrigerant charge but will not protect the compressor if all the refrigerant is lost, since the low charge detection requires some refrigerant in the system in order to function properly.

SUMMARY OF THE INVENTION

It is therefore an object of this invention to provide an improved method and apparatus for noninvasively protecting a refrigeration system against loss of refrigerant and lubricant.

The invention is carried out in an air conditioning system having a compressor, a condenser, and an evaporator, the evaporator having refrigerant inlet and outlet ends normally at different temperatures, and the system containing a refrigerant carrying a lubricant which lubricates the compressor. The control protects the system against loss of refrigerant with a first sensor for sensing the compressor temperature, a second sensor for sensing the temperature at the inlet of the evaporator, and a third sensor for sensing the temperature at the outlet of the evaporator. A circuit responsive to the sensed temperatures determines the temperature differential across the evaporator and turns off the compressor if the temperature differential is below a differential threshold and the compressor temperature is above an abnormal temperature threshold.

BRIEF DESCRIPTION OF THE DRAWINGS

The above and other advantages of the invention will become more apparent from the following description taken in conjunction with the accompanying drawings wherein like references refer to like parts.

DESCRIPTION OF THE INVENTION

Figure 1:
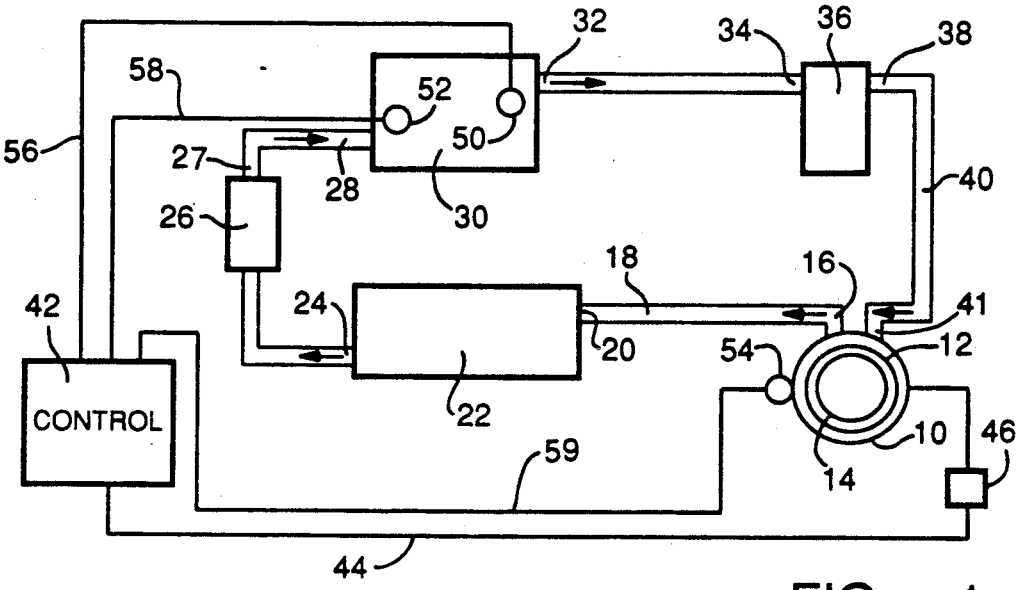
FIG. 1 is a schematic diagram of an air conditioning system equipped with a control according to the invention.

Referring to FIG. 1, an air conditioning refrigerant compressor 10 has a drive shaft (not shown) driven by a pulley assembly 12 which includes an electromagnetic clutch 14 energizable to connect pulley assembly 12 in driving engagement with the compressor drive shaft. An outlet 16 of the compressor 10 is attached to a flexible hose 18 which is connected to an inlet 20 of a condenser 22. The condenser 22 is typically located in a manner to be exposed to a flow of air for cooling and liquefying warm refrigerant discharged from the compressor 10. An outlet 24 of the condenser 22 is connected to an orifice tube-type expander 26 to effect rapid cooling of the refrigerant. The outlet 27 of orifice expander 26 is connected to an inlet 28 of an evaporator 30.

Liquid refrigerant in the evaporator 30 is vaporized in vertical passages provided with fins for efficient heat transfer from air flowing outside the evaporator passages to the refrigerant within the evaporator passages. The evaporator 30 has an outlet 32 which is connected to an inlet 34 of an accumulator 36. The accumulator 36 separates the liquid and gaseous refrigerant, and discharges the gaseous component through an outlet 38 to an inlet 41 of the compressor 10 via a suction line 40. As thus far described, the air conditioning system is of conventional construction.

A control 42 for operating the system has an output line 44 to a relay 46 which is coupled to the clutch 14 for engaging or disengaging the compressor drive to effectively turn the compressor 10 on or off. The control 42 is microprocessor based and is programmed according to well known algorithms to cycle the clutch 14 on and off during normal operation, according to inputs not shown or discussed here.

To guard against one type of abnormal operation wherein the refrigerant charge is very low or zero, three thermistors 50, 51 and 54 provide inputs on lines 56, 58 and 59 to the control 42 which determines the abnormal condition from the inputs. A first thermistor 50 is coupled to the air side (outside the refrigerant passages) of the evaporator 30 at its outlet 32; a second thermistor 52 is coupled to the air side of the evaporator at its inlet 28; and the third thermistor 54 is connected to the body of the compressor 10.

Figure 2:
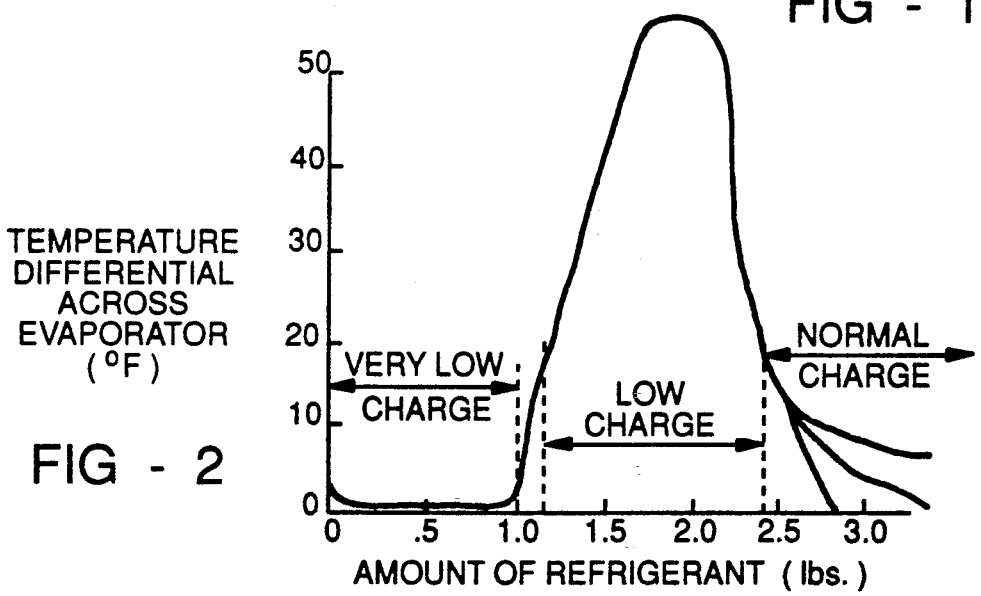
FIGS. 2 and 3 are graphs of evaporator temperature differential and compressor temperature, respectively.
Figure 3:
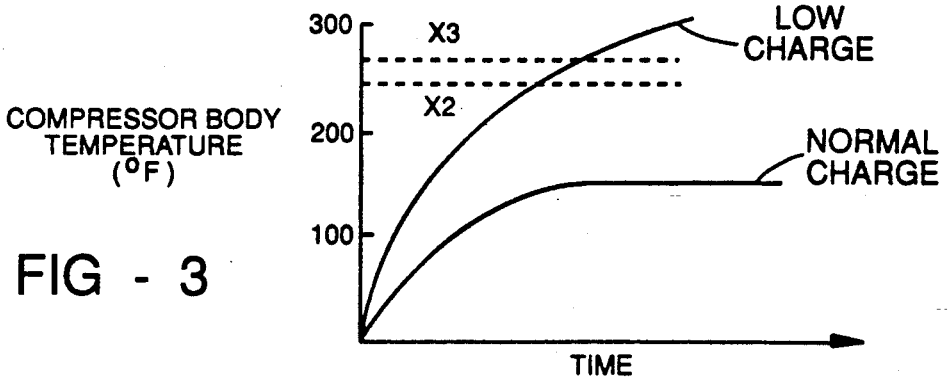

Referring to the graphs of FIGS. 2 and 3 for an explanation of the control parameters, the temperature drop (delta-T) across the evaporator 30 varies as a function of the refrigerant charge as shown in FIG. 2. At no and very low charges (VERY LOW CHARGE), the temperature differential is very low. The differential becomes large at moderately low charge (LOW CHARGE), and becomes low again at normal charge (NORMAL CHARGE). The three curves in the NORMAL CHARGE range indicate that other factors, such as ambient temperature, speed, etc., will greatly influence the temperature differential. High temperature differentials, say, above 15 degrees F., reveal a moderately low charge and can be used for detecting that condition. Low temperature differentials (below about 5 degrees F.) occur at substantially no charge.

In the algorithm set forth below, a temperature differential threshold X1 is set at about 5 degrees F. to detect the zero to very low charge. However, low differentials also occur in the normal operating range. To discriminate between very low charge and normal, charge the compressor body temperature sensed by the thermistor 54 is used.

FIG. 3 shows typical compressor body temperature curves as a function of time from the start of compressor operation for normal operation and for very low charge operation. For normal operation, the temperature levels off at a plateau shown here as about 150 degrees F., but the low charge operation causes much faster rise and higher temperatures which can increase even above 300 degrees F. where compressor failure may occur. A compressor temperature threshold X2 is selected at about 250 degrees F. as an indication that the normal compressor temperature has been exceeded.

This event, in conjunction with a low evaporator temperature differential (below about 5 degrees F.), is the basis for the algorithm which detects very low charge and leads to a conclusion that the compressor clutch 14 is to be disengaged and locked out from further engagement until the system is serviced. A higher compressor critical temperature threshold X3, chosen at about 270 degrees F., is used to indicate that critical or destructive temperatures are being approached, and the compressor clutch 14 should be disengaged regardless of the condition of the refrigerant charge.

Figure 4:
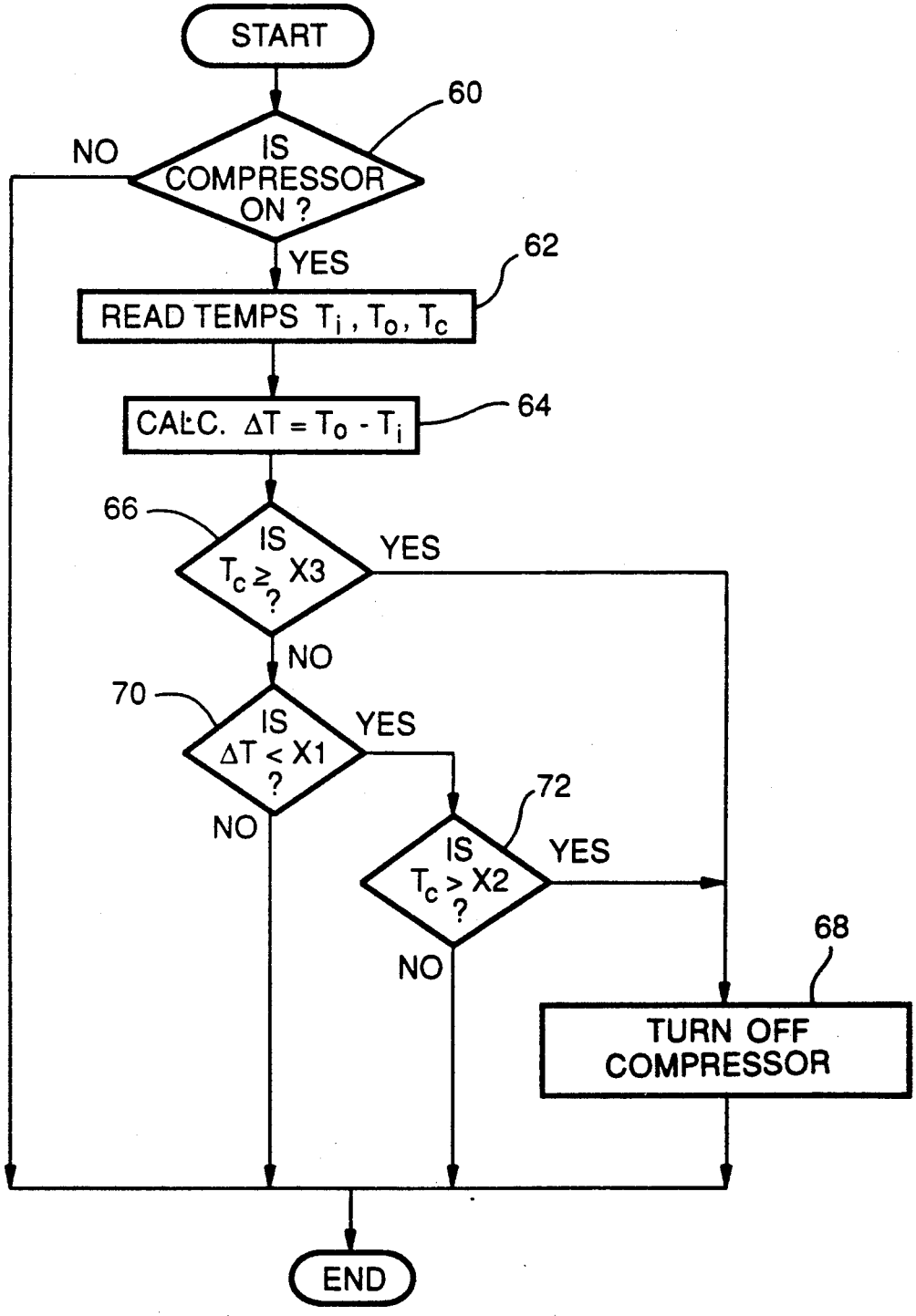
FIG. 4 is a flow chart representing the control algorithm, according to the invention.

The program in the control 42 for carrying out the very low charge detection and critical compressor body temperature detection is represented by the flow chart of FIG. 4. Step 60 determines whether the compressor is on. This can be decided by checking the control 42 on output line 44, and the program proceeds only if the compressor 10 is on. Then, in step 62, the three thermistor temperatures, evaporator inlet $T_i$, evaporator outlet $T_o$, and compressor temperature $T_c$, are read.

Next the temperature differential, delta-T, is calculated from $T_i$ and $T_o$ in step 64. If the compressor temperature has reached the critical temperature X3, as determined in step 66, a flag is set and/or a compressor disable signal is issued to turn off the compressor 10 in step 68. If the critical temperature has not been reached, then step 70 determines whether the evaporator temperature differential is below the threshold X1. If so, step 72 compares the compressor temperature $T_c$ to the threshold X2. If the temperature is above X2, the program goes to step 68 to turn off the compressor 10, issue a disable signal, and optionally issue a warning of low charge. The output line 44 of the control 42 then causes the compressor clutch 14 to be disengaged in response to step 68.

Thus, it is apparent that by the simple expedient of monitoring the three thermistors 50–54 and making comparisons to judiciously selected thresholds, it can be determined if the refrigerant charge is very low or zero or if the compressor is reaching a critical temperature for any reason. This control is executed periodically and is used in conjunction with other controls which monitor moderately low charge. For example, in FIG. 2, the low charge region above 15 degrees F. evaporator temperature differential can be monitored on the basis of the differential alone. If that is combined with the subject method of detecting very low charge, only a small region (1.0–1.1 lbs refrigerant) is left unchecked, and the likelihood of evaporator operation in that region for an extended period is nearly zero. The result is that the system can be monitored noninvasively and the potential leakage paths are minimized.

The embodiments of the invention in which an exclusive property or privilege is claimed are defined as follows:

1. In an air conditioning system having a compressor, a condenser, and an evaporator, the evaporator having refrigerant inlet and outlet ends normally at different temperatures, and the system containing a refrigerant which carries a lubricant to lubricate the compressor; control apparatus for protecting the system against loss of refrigerant comprising:

a first sensor on the compressor for sensing the compressor temperature and having a first output signal;

a second sensor for sensing the temperature at the inlet end of the evaporator and having a second output signal;

a third sensor for sensing the temperature at the outlet end of the evaporator and having a third output signal; and control means for determining the temperature differential across the evaporator from the second and third output signals and for issuing a signal when the temperature differential is below a first threshold indicative of low refrigerant charge and the first output signal is above a second threshold indicative of abnormal compressor temperature.

2. In an air conditioning system charged with refrigerant and having a compressor, a condenser, and an evaporator, the evaporator having an air side for contact with air to be cooled by the evaporator and having refrigerant inlet and outlet ends normally at different temperatures, the refrigerant carrying a lubricant to lubricate the compressor; control apparatus for protecting the system against loss of refrigerant comprising:

a first thermistor on the compressor for sensing the compressor temperature;

a second thermistor on the air side of the evaporator for sensing the temperature at the inlet end of the evaporator;

a third thermistor on the air side of the evaporator for sensing the temperature at the outlet end of the evaporator; and control means for determining a temperature differential across the evaporator from the second and third thermistors, and for issuing a compressor disable signal when the temperature differential is below a first threshold indicative of low refrigerant charge and the compressor temperature sensed by the first thermistor is above a second threshold indicative of abnormal compressor temperature, and for disabling the compressor in response to the compressor disable signal, whereby the compressor is turned off when the refrigerant charge is insufficient to adequately lubricate the compressor.

3. The control apparatus as defined in claim 2 wherein the control means further issues a disable signal when the compressor temperature is above a third threshold indicative of a critical compressor temperature.

4. In an air conditioning system having a compressor, a condenser, and an evaporator, the evaporator having refrigerant inlet and outlet ends normally at different temperatures, and the system containing a refrigerant; a method of controlling the system comprising:

measuring the compressor temperature;

comparing the compressor temperature to an abnormal temperature threshold;

measuring the temperatures at the inlet and outlet ends of the evaporator and determining a temperature differential across the evaporator;

comparing the temperature differential to a differential threshold indicative of low refrigerant charge; and turning off the compressor if the temperature differential is below the differential threshold and the compressor temperature is above the abnormal temperature threshold.

5. The method as defined in claim 4 including the further steps of:

comparing the compressor temperature to a critical temperature threshold which is higher than the abnormal temperature threshold, and turning off the compressor if the compressor temperature is above the critical temperature threshold.

* * * * *